US009651256B2

(12) United States Patent
Noman et al.

(10) Patent No.: US 9,651,256 B2
(45) Date of Patent: May 16, 2017

(54) GRAVITY-STYLE FURNACE SUBUNIT INSIDE A GAS-INDUCED DRAFT FURNACE

(75) Inventors: Shiblee S. M. Noman, Frisco, TX (US); Jesse Sanchez, Mansfield, TX (US)

(73) Assignee: Lennox Industries Inc., Richardson, TX (US)

( * ) Notice: Subject to any disclaimer, the term of this patent is extended or adjusted under 35 U.S.C. 154(b) by 492 days.

(21) Appl. No.: 13/310,867

(22) Filed: Dec. 5, 2011

(65) Prior Publication Data

US 2013/0139802 A1 Jun. 6, 2013

(51) Int. Cl.

| | |
|---|---|
| ***F23N 5/24*** | (2006.01) |
| ***F24H 3/10*** | (2006.01) |
| ***F24H 9/20*** | (2006.01) |

(52) U.S. Cl.

CPC ..... *F23N 5/242* (2013.01); *F24H 3/105* (2013.01); *F24H 9/2085* (2013.01); *F23D 2900/00015* (2013.01); *F23N 2027/24* (2013.01); *F23N 2031/04* (2013.01); *Y10T 29/49826* (2015.01)

(58) Field of Classification Search

CPC .. H02J 7/00; F24H 3/065; F24H 3/087; F24H 3/105; F24H 9/2085; F23C 5/00; F28D 9/0031; F23N 5/242; F23N 2031/04; F23N 2027/24

USPC ..... 126/110 R, 110 A, 110 B, 110 C, 110 D, 126/116 A, 116 B, 116 C

See application file for complete search history.

(56) References Cited

U.S. PATENT DOCUMENTS

| | | | | | |
|---|---|---|---|---|---|
| 3,171,595 | A | * | 3/1965 | Krenke | 236/9 A |
| 3,185,201 | A | * | 5/1965 | Herbst et al. | 122/23 |
| 4,171,089 | A | * | 10/1979 | Schossow | 237/55 |
| 4,242,078 | A | * | 12/1980 | Nelson et al. | 431/45 |
| 4,261,326 | A | * | 4/1981 | Ihlenfield | 126/110 R |
| 4,942,863 | A | * | 7/1990 | Chou et al. | 126/110 E |
| 5,060,722 | A | * | 10/1991 | Zdenek et al. | 165/170 |
| 5,427,086 | A | * | 6/1995 | Brownell | 126/110 R |

* cited by examiner

*Primary Examiner* — Alissa Tompkins
*Assistant Examiner* — Benjamin W Johnson
(74) *Attorney, Agent, or Firm* — Bell Nunnally & Martin LLP; Craig J. Cox

(57) ABSTRACT

A gravity-style furnace subunit for a gas-induced draft furnace. A heat conduction tube configured to be located inside of a gas-induced draft furnace cabinet, the heat conduction tube being separated from a row of draft-induced heat conduction tubes inside the cabinet. A burner assembly having a burner tube located within the heat conduction tube through an inlet opening of the heat conduction tube. The burner assembly permits air flow through the inlet opening into the heat conduction tube. A pilot assembly located within the heat conduction tube and adjacent to the burner tube. A thermopile module having located adjacent to a flame outlet of the pilot assembly within the heat conduction tube. A gas valve configured to control gas flow to the burner assembly, the gas valve electrically coupled to the thermopile module and to actuate gas flow there-through when the thermopile module generates a predefined voltage difference.

19 Claims, 4 Drawing Sheets

GRAVITY-STYLE FURNACE SUBUNIT INSIDE A GAS-INDUCED DRAFT FURNACE

TECHNICAL FIELD

Figure 1:
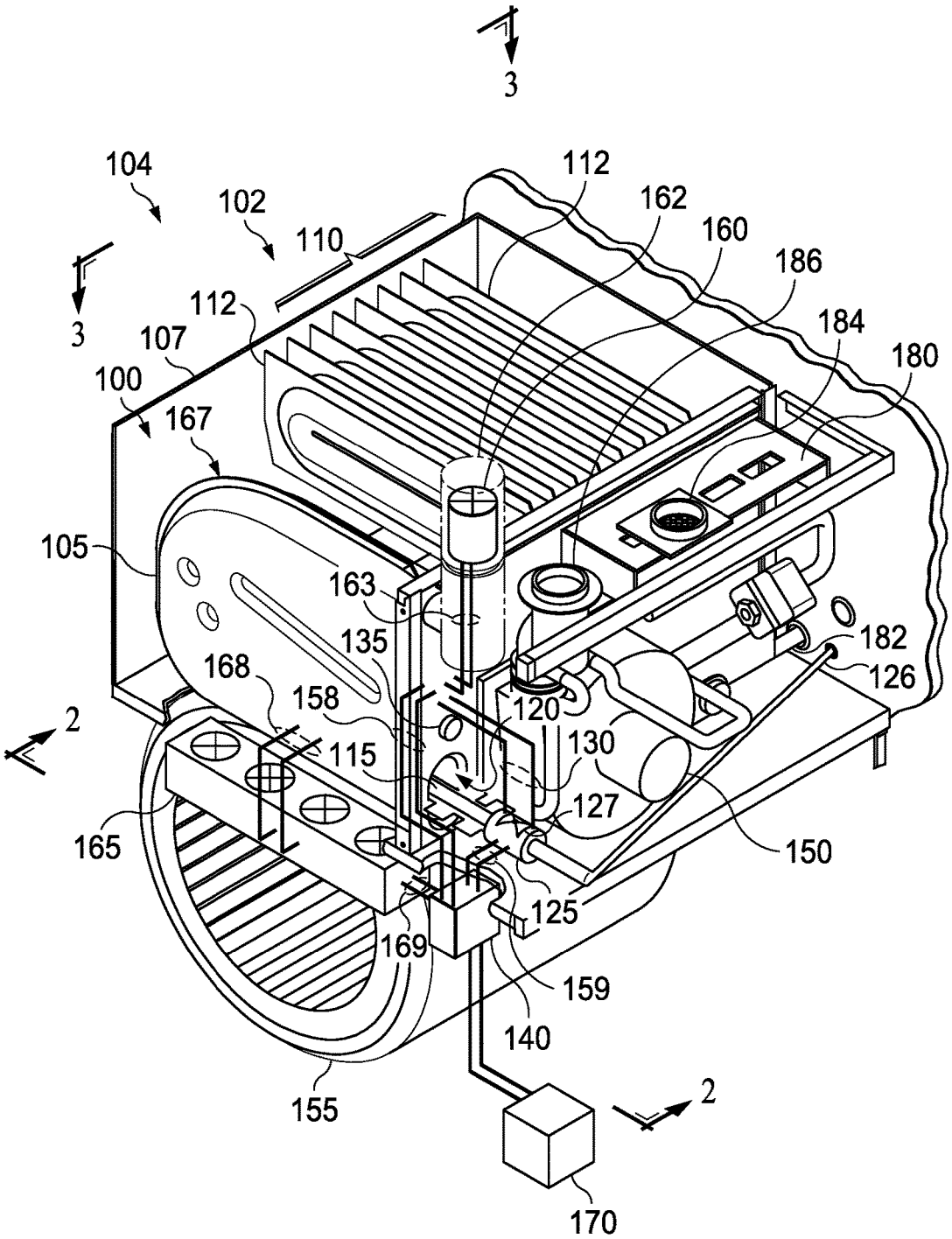

This application is directed, in general, to furnace systems and, more specifically, to a gravity-style furnace subunit of a gas-induced draft furnace of a furnace system.

BACKGROUND

Gas-induced draft furnaces rely upon several electrically powered components, such as electrically powered fans, to support their proper functioning. When the electrical power to a building heated by such furnaces goes out, e.g., due to power-grid failure, the furnace can no longer heat the building. As such, in colder environments, an extended power-grid failure can cause the building to become uncomfortable to occupy.

SUMMARY

One embodiment of the disclosure is a gravity-style furnace subunit for a gas-induced draft furnace. The subunit comprises a heat conduction tube configured to be located inside of a gas-induced draft furnace cabinet, the heat conduction tube being separated from a row of draft-induced heat conduction tubes inside the cabinet. The subunit also comprises a burner assembly having a burner tube located within the heat conduction tube through an inlet opening of the heat conduction tube, wherein the burner assembly permits air flow through the inlet opening into the heat conduction tube. The subunit further comprises a pilot assembly located within the heat conduction tube and adjacent to the burner tube and a thermopile module having located adjacent to a flame outlet of the pilot assembly within the heat conduction tube. The subunit also comprises gas valve configured to control gas flow to the burner assembly, wherein the gas valve is electrically coupled to the thermopile module and is configured to actuate gas flow there-through when the thermopile module generates a predefined voltage difference.

Another embodiment is a furnace system. The system comprises a gas-induced draft furnace housed inside of a cabinet and a gravity-style furnace subunit housed inside of the cabinet, the subunit including the above-described elements.

Still another embodiment is another gravity-style furnace subunit for a gas-induced draft furnace. The subunit comprises a heat conduction tube configured to be located inside of a gas-induced draft furnace cabinet, the heat conduction tube being separated from a row of draft-induced heat conduction tubes coupled to a first burner assembly inside the cabinet. The subunit comprises a second different burner assembly having a burner tube located within the heat conduction tube through an inlet opening of the heat conduction tube, wherein the second burner assembly permits air flow through the inlet opening into the heat conduction tube. The subunit comprises a pilot assembly located within the heat conduction tube and adjacent to the burner tube. The subunit comprises a gas valve configured to control gas flow to the second burner assembly, wherein the gas valve is configured to actuate gas flow there-through.

BRIEF DESCRIPTION

Figure 2:
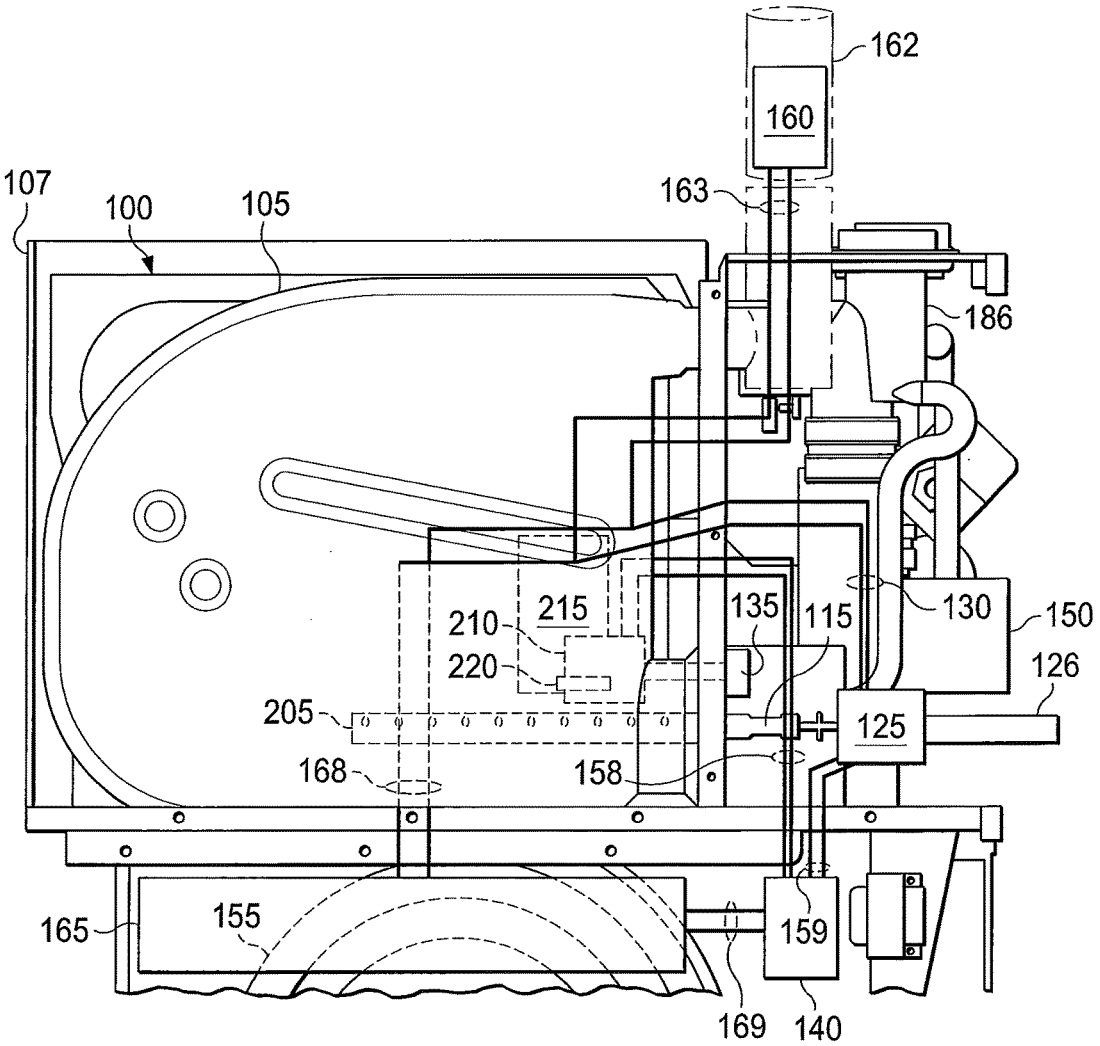
Figure 3:
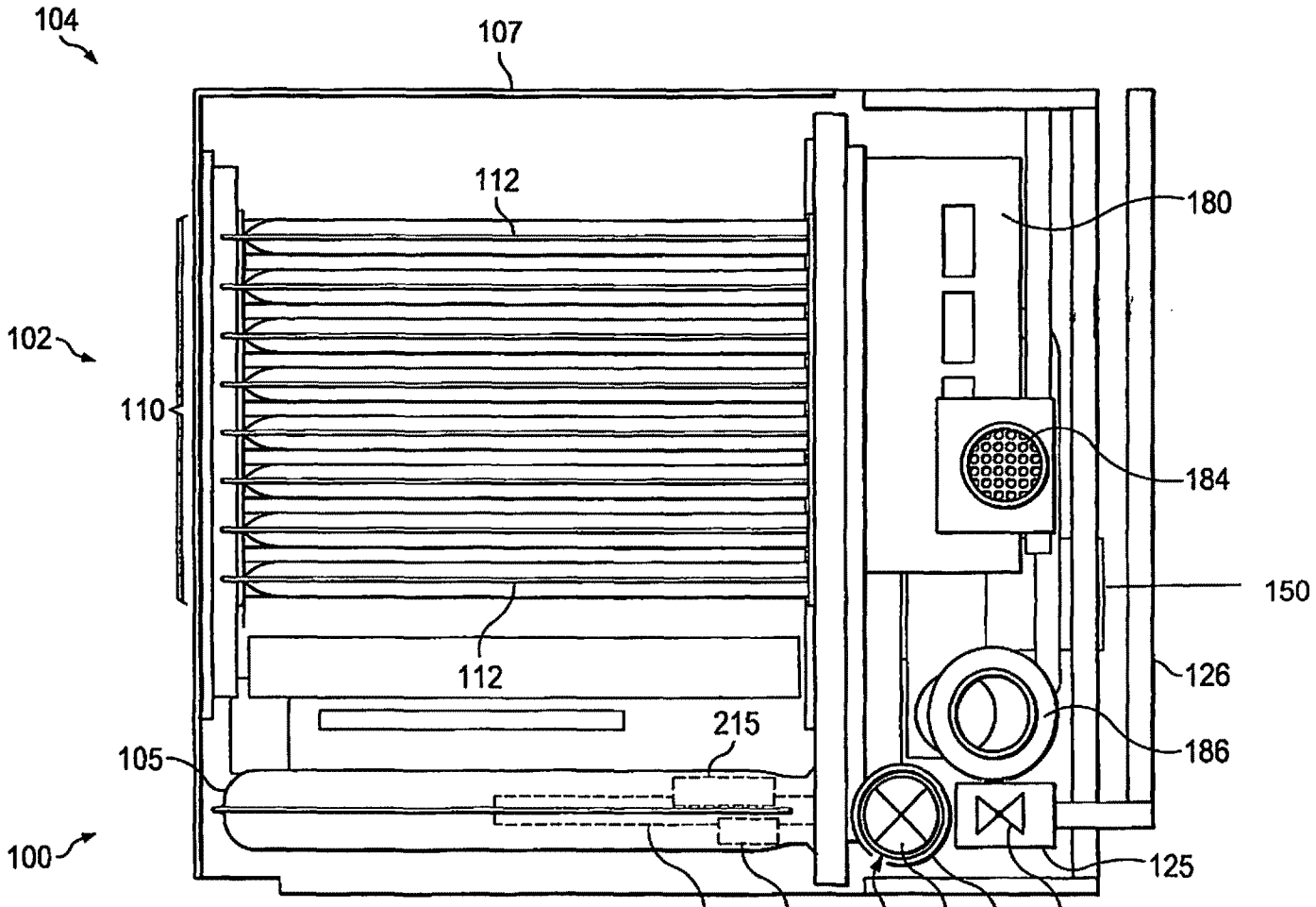
Figure 4:
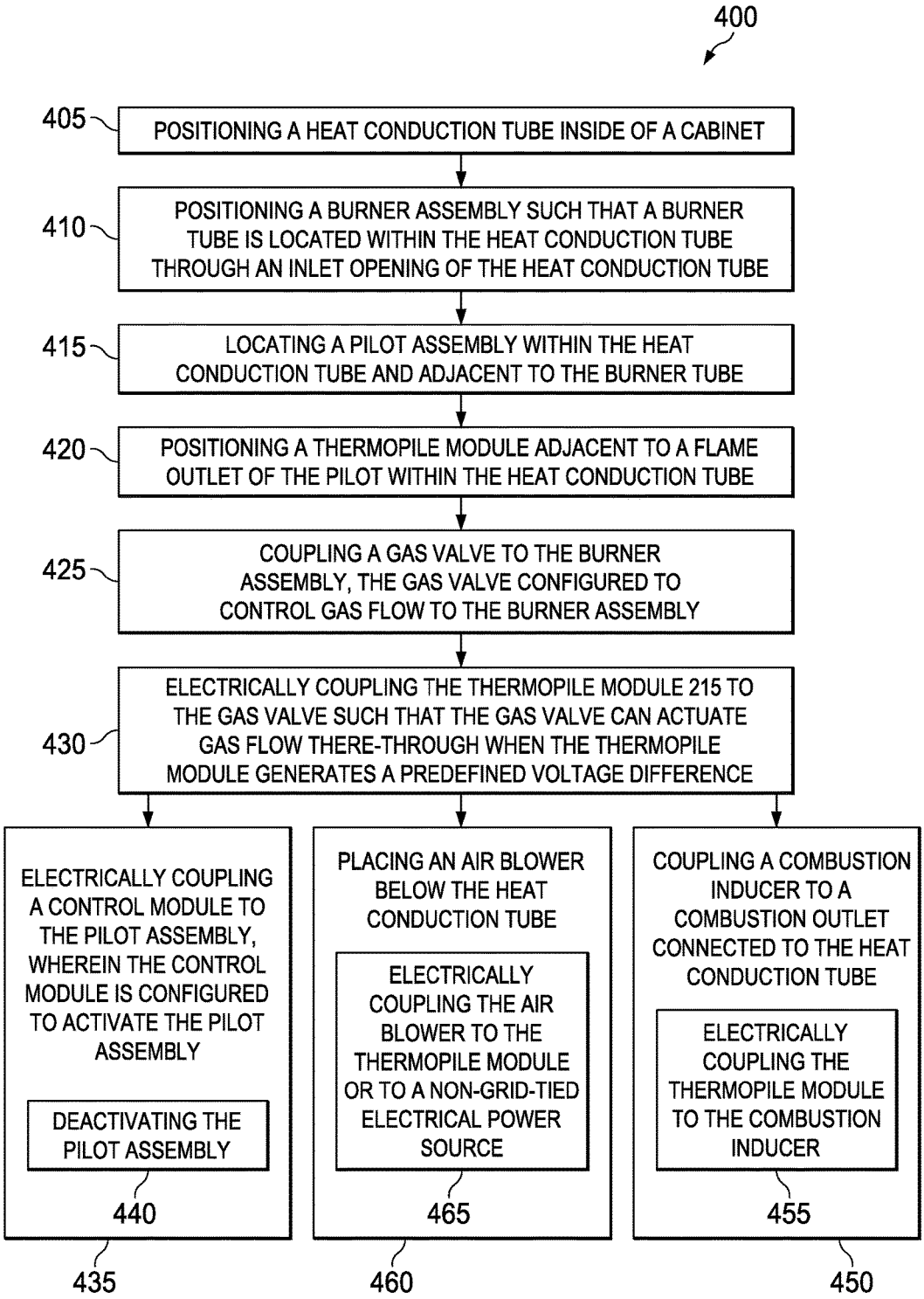

Reference is now made to the following descriptions taken in conjunction with the accompanying drawings, in which:

FIG. 1 illustrates an isometric view of an example gravity-style furnace subunit of the disclosure for an example gas-induced draft furnace of the disclosure;

FIG. 2 presents a cut-away side view of the example gravity-style furnace subunit along view line 2 in FIG. 1;

FIG. 3 presents plan view of the example gravity-style furnace subunit along view line 3 in FIG. 1; and FIG. 4 presents a flow diagram of an example method of manufacturing a furnace system of the disclosure, such as the furnace system unit and its gravity style furnace subunit as depicted in FIGS. 1-3.

DETAILED DESCRIPTION

The term, "or," as used herein, refers to a non-exclusive or, unless otherwise indicated. Also, the various embodiments described herein are not necessarily mutually exclusive, as some embodiments can be combined with one or more other embodiments to form new embodiments.

As part of the present disclosure, it was discovered that by introducing a separate gravity-style furnace subunit into a gas-induced draft furnace, some heat can be generated and circulated by the subunit when there is no external electrical power to the building housing the furnace, or at least the gas-induced draft furnace in building. The gravity-style furnace subunit relies on a gravity or buoyancy effect, of cold air falling and warm air rising, to facilitate the circulation of air heated by the subunit. The gravity-style furnace subunit is configured to operate without any external electrical power, although some embodiments of the subunit can benefit from the use of internal electrical power to enhance air or combusted fuel circulation.

One embodiment of the disclosure is a gravity-style furnace subunit for a gas-induced draft furnace. FIG. 1 illustrates an isometric view of an example gravity-style furnace subunit 100 of the disclosure for an example gas-induced draft furnace 102 of the disclosure. FIG. 2 presents a cut-away side view of the example gravity-style furnace subunit 100, along view line 2 in FIG. 1. FIG. 3 presents a plan view of the example gravity-style furnace subunit 100, along view line 3 in FIG. 1. The subunit 100 and furnace 102 can be part of a furnace system 104 that further includes ducts, thermostats and other components familiar to those skilled in the pertinent art.

With continuing reference to FIGS. 1-3 throughout, the gravity-style furnace subunit 100, comprises a heat conduction tube 105 configured to be located inside of a gas-induced draft furnace cabinet 107, the heat conduction tube being separated from a row 110 of draft-induced heat conduction tubes 112 inside the cabinet 107. The subunit 100 further comprises a burner assembly 115 having a burner tube 205 located within the heat conduction tube 105 through an inlet opening 120 of the heat conduction tube 105. The burner assembly 115 is configured (e.g., with the appropriate diameter) to permit air flow through the inlet opening 120 into the heat conduction tube 105.

The subunit 100 also comprises a pilot assembly 210 located within the heat conduction tube 105 and adjacent to the burner tube 205, and a thermopile module 215 located adjacent to a flame outlet 220 of the pilot assembly 210 within the heat conduction tube 105. The subunit 100 further comprises a gas valve 125 configured to control gas flow to the burner assembly 115. The gas valve 125 is electrically coupled to the thermopile module (e.g., a voltage send via wires 130) and is configured to actuate gas flow there-through when the thermopile module 215 generates a predefined voltage difference.

Although it is located inside of, and is part of the gas-induced draft furnace 102, the above-described components of the gravity-style furnace subunit 100 are separate from, and work independent of, the components of the gas-induced draft furnace 102.

As illustrated in FIGS. 1 and 3 in some embodiments, the heat conduction tube 105 is located at one side of the gas-induced draft furnace cabinet 107, e.g., to facilitate manual access to the pilot assembly 210 coupled to the heat conduction tube 105. Although only one heat conduction tube 105 of the subunit 100 is depicted, additional heat conduction tubes of the subunit 100 could be positioned inside the cabinet 107, if desired. In some cases, the heat conduction tube 105 can be a clam-shell type of tube, e.g., with two halves that are joined together to form a passageway having an inlet 120 and an outlet (e.g., coupled to an outlet tube 162). One skilled in the art would appreciate that other types or styles of conduction tubes 105 could be used as part of the subunit 100.

In some embodiments, the pilot assembly 210 is configured to be manually activated to generate a pilot flame. For instance, a gas feed to the pilot assembly 210, e.g., from a separate gas line 126 to the subunit 100 can be opened, and the pilot flame lit with a match or spark generator 135 (e.g., a push button configured, when actuated, to generate a spark via a quartz crystal and an ignition hammer). For instance, the gas valve 125 can include, or be, a manually-actuated valve 127 that can be manually opened or closed in conjunction with starting the pilot flame. In some cases, the gas valve 125 can include, or be, a solenoid valve that is actuated to an open state when a voltage difference from the thermopile 215 is produced, e.g., by the pilot flame and this voltage is sent (e.g., via wires 130) to the gas valve 125. When the valve is 125 opened, gas is thereby supplied to the heat conduction tube 105, until the pilot flame is turned off or goes out, and consequently, the thermocouple stops producing the voltage difference that keeps the gas valve 125 open, and subsequently, the gas valve 125 shuts off the gas supply.

In other embodiments, the pilot assembly 210 is configured to be automatically activated by a control module 140 of the subunit 100. For instance, in some cases, the control module 140 can be configured to activate (e.g., via a signal sent through wires 158) the pilot assembly 210 and/or the valve 125 (e.g., via a signal sent through wires 159). Activation can occur when electrical power to a component (e.g., the draft inducer 150 and/or air blower 155) of the gas-induced draft furnace 102 located inside of the cabinet 107 is lost for a predefined period (e.g., 5 to 10 minutes, to ensure that the subunit 100 does not activate due to a brief interruption of power). In some cases, the control module 140 can also be configured to deactivate the pilot assembly 140 when electrical power to a component of the gas-induced draft furnace inside of the cabinet is resumed for a predefined period (e.g., 5 to 10 minutes to ensure that the subunit 100 does not deactivate due to a brief resumption of power).

In some cases, the control module 140 can be further configured to activate only when the conditioned space of a building that the furnace system 102 is located in, drops below a pre-defined temperature, or, to deactivate when the temperature of the conditioned space is above a pre-defined value. In some cases, the control module 140 can include, or be, a switch (e.g., a relay switch) that is configured to activate the pilot assembly 210 when power is lost such as described above. Based on the present disclosure, one of ordinary skill would appreciate how the control module 140 could similarly be configured to activate/deactivate the pilot assembly 210 or components of the subunit 100 when power is lost to a floor or to an entire building heated by the furnace 102.

The thermopile module 215 can be or include any device configured to use the thermoelectric effect to generate a voltage difference when one or more thermo-sensors of the thermopile are heated by a flame, e.g., the pilot flame, and, the flame from the combustion of gas emitted from the burner tube 205. In some embodiments, the thermopile module 215 can include a plurality of thermo-sensors so that the module 215 can generate a larger voltage difference and thereby provide more power to multiple components of the subunit 100.

In some embodiments, to facilitate increased flow of gas through the heat conduction tube 105, the subunit 100 includes a combustion inducer 160 coupled to a combustion outlet 162 connected to the heat conduction tube 105. In some embodiments, the combustion inducer 160 is powered by the thermopile module 215 (i.e., via a voltage sent through wires 163).

In some embodiments, to facilitate increase air circulation through the conditioned space of the building, the subunit 100 includes an air blower 165, e.g., located below the heat conduction tube 105. The blower 165 can be configured to blow return air across an outer surface 167 of the heat conduction tube 105. In some cases the air blower 165 is powered by the thermopile module 215 (e.g., from a voltage sent through wires 168).

In some cases, the air blower 165 can be activated or deactivated by the control module 140 (e.g., via a signal sent through wires 169). For instance, in some cases, the air blower 165 can be powered by a non-grid-tied electrical power source 170 of the building heated by the gas-induced draft furnace 102 and the subunit 100. In such cases, it can be advantageous for the control module 140 to distribute electrical power to the air blower 165 in accordance with the amount of power received from the power source 170. Examples of non-grid-tied electrical power sources 170 include a battery bank charged by the electrical power grid, prior to the loss of this external electrical power, and/or charged from electricity generated by one or more internal power sources such as wind turbines, photo voltaic panels, or fossil-fuel powered electrical generators associated with the building.

Another embodiment of the disclosure is a furnace system 104. The system 104 comprises a gas-induced draft furnace 102 housed inside of a cabinet 107, and a gravity-style furnace subunit 100 housed inside of the cabinet 100. The subunit 100 can include any of the embodiments discussed above in the context of FIGS. 1-3.

In some embodiments, the gravity-style furnace subunit 100 can include a combustion inducer 160 coupled to a combustion outlet 162 connected to the heat conduction tube 105 or include an air blower 165 located below the heat conduction tube 105 and configured to blow air across an outer surface 167 of the heat conduction tube. Similar to the other components of the subunit 100, the combustion inducer 160, the combustion outlet 162, or the air blower 165, can be separate from, an operate independent of, the gas-induced draft furnace 102. In some embodiments, the one or both of the combustion inducer 160 and air blower 165 are powered by the thermopile 215. In some embodiments, to facilitate air circulation, the cabinet 107 is located in a lowest level of a building that the gravity-style furnace subunit 100 and the gas-induced draft furnace 102 are configured to heat.

Still another embodiment of the disclosure is a method of manufacturing a furnace system. FIG. 4 presents a flow diagram of an example method 400 of manufacturing a furnace system of the disclosure, such as any of the embodiments of the furnace system 104 and its gravity style furnace subunit 100 as depicted in FIGS. 1-3.

The method 400 comprises a step 405 of positioning a heat conduction tube 105 inside of a cabinet 107, the heat conduction tube 105 separate from a row 110 of draft-induced heat conduction tubes 112 inside the cabinet 107. The method also comprises a step 410 of positioning a burner assembly 115 such that a burner tube 205 is located within the heat conduction tube through an inlet opening 120 of the heat conduction tube 105. The burner assembly 115 permits air-flow through the inlet opening 120 into the heat conduction tube 105, to thereby support the emission of a flame into the inlet opening 120 of the heat conduction tube 105.

The method 400 further comprises a step 415 of locating a pilot assembly 210 within the heat conduction tube 105 and adjacent to the burner tube 205, a step 420 of positioning a thermopile module 215 adjacent to a flame outlet 220 of the pilot assembly 210 within the heat conduction tube 105 and a step 425 of coupling a gas valve 125 to the burner assembly 115, the gas valve 125 configured to control gas flow to the burner assembly 115. In another step 430, the thermopile module 215 is electrically coupled to the gas valve 125 such that the gas valve 125 can actuate gas flow there-through when the thermopile module 215 generates a predefined voltage difference.

Some embodiments of the method 400 further include a step 435 of electrically coupling a control module 140 to the pilot assembly 210, wherein the control module 140 is configured to activate the pilot assembly 210 (e.g., turn on the pilot flame) when electrical power to a component 150, 155 of the gas-induced draft furnace 102 located in the cabinet 107 is lost for a predefined period, and, and step 440 of deactivating the pilot assembly (e.g., turn off the pilot flame) when electrical power to the component 150, 155 is resumed for a second predefined period.

Some embodiments of the method 400 further include a step 450 of coupling a combustion inducer 160 to a combustion outlet 162 connected to the heat conduction tube 105, and, a step 455 of electrically coupling the thermopile module 205 to the combustion inducer 160 such that the combustion inducer 160 can be powered by the thermopile module 205

Some embodiments of the method 400 further induce a step 460 of placing an air blower 165 below the heat conduction tube 165, the air blower 165 configured to blow air (e.g., return air) across an outer surface 167 of the heat conduction tube 105. Embodiments of the method can further include a step 465 of electrically coupling the air blower 165 to the thermopile module 215 or to a non-grid-tied electrical power source 170 of the building heated by the gas-induced draft furnace 102.

One skilled in the art would appreciate that there would be other steps to complete manufacture of the system 104, such as assembling the separate components of the gas-induced draft furnace 102, including the row 110 of heat conduction tubes 112, air blower 155, a burner assembly 180, gas feed, 182, air inlet 184, combustion outlet 186, draft inducer 150, and other components familiar to those skilled in the art.

Those skilled in the art to which this application relates will appreciate that other and further additions, deletions, substitutions and modifications may be made to the described embodiments.

What is claimed is:

1. A gravity-style furnace subunit, comprising:

a heat conduction tube configured to be located inside a cabinet of a gas-induced draft furnace, the heat conduction tube being separated from:

a row of draft-induced heat conduction tubes coupled to a first burner assembly, and an electrically-powered air blower located adjacent to the row of draft-induced heat conduction tubes, wherein the row of draft-induced heat conduction tubes and the electrically powered air blower are located inside the cabinet; wherein the gravity-style furnace subunit further comprises:

a second different burner assembly having a burner tube located within the heat conduction tube through an inlet opening of the heat conduction tube, wherein the second burner assembly permits air flow through the inlet opening into the heat conduction tube;

a pilot assembly located within the heat conduction tube and adjacent to the burner tube;

a thermopile module located adjacent to a flame outlet of the pilot assembly within the heat conduction tube; and a gas valve configured to control gas flow to the second burner assembly, wherein:

the pilot assembly is configured to be automatically activated by a control module of the subunit, the control module is configured to activate the pilot assembly to produce a pilot flame when, due to power-grid failure, the electrically-powered air blower is off for a predefined period, and the gas valve is electrically coupled to the thermopile module and is configured to allow gas flow there-through when the thermopile module, upon exposure to the pilot flame, generates a predefined voltage difference that causes the gas valve to actuate to an open position;

wherein the gravity-style subunit and the draft-induced heat conduction tubes comprise separate air inlets and separate combustion outlets and wherein the heat conduction tube is operable to use gravity to facilitate the circulation of air heated by the gravity-style subunit when external electrical power is unavailable.

2. The subunit of claim 1, wherein the gravity-style furnace subunit is operable to function independently of the gas-induced draft furnace.

3. The subunit of claim 1, wherein the control module is configured to deactivate the pilot assembly to turn off the pilot flame, whereby the predefined voltage difference is no longer generated and the gas valve actuates to a closed position, when electrical power from the power grid to the electrically-powered air blower is resumed for a predefined period.

4. The subunit of claim 1, further including a combustion inducer coupled to a combustion outlet connected to the heat conduction tube.

5. The subunit of claim 4, wherein the combustion inducer is powered by the thermopile module.

6. The subunit of claim 1, further including an air blower located below the heat conduction tube and configured to blow return air across an outer surface of the heat conduction tube.

7. The subunit of claim 6, wherein the air blower is powered by the thermopile module.

8. The subunit of claim 6, wherein the air blower is powered by a non-grid tied electrical power source of a building heated by the gas-induced draft furnace.

9. A furnace system, comprising a gas-induced draft furnace housed inside of a cabinet; and a gravity-style furnace subunit housed inside of the cabinet, the subunit including:

a heat conduction tube configured to be located inside of the cabinet, the heat conduction tube being separated from:

a row of draft-induced heat conduction tubes coupled to a first burner assembly, and an electrically-powered air blower located adjacent to the row of draft-induced heat conduction tubes, wherein the row of draft-induced heat conduction tubes and the electrically powered air blower are located inside the cabinet; wherein the gravity-style furnace subunit further comprises:

a second different burner assembly having a burner tube located within the heat conduction tube of the gravity-style furnace subunit through an inlet opening of the heat conduction tube, wherein the second burner assembly permits air flow through the inlet opening into the heat conduction tube;

a pilot assembly located within the heat conduction tube and adjacent to the burner tube;

a thermopile module located adjacent to a flame outlet of the pilot assembly within the heat conduction tube; and a gas valve configured to control gas flow to the second burner assembly, wherein:

the pilot assembly is configured to be automatically activated by a control module of the subunit, the control module is configured to activate the pilot assembly to produce a pilot flame when, due to power-grid failure, at least one of the electrically-powered air blower or the electrically-powered draft inducer are off for a predefined period, and the gas valve is electrically coupled to the thermopile module and is configured to allow gas flow therethrough when the thermopile module, upon exposure to the pilot flame, generates a predefined voltage difference that causes the gas valve to actuate to an open position;

wherein the gravity-style subunit and the draft-induced heat conduction tubes comprise separate air inlets and separate combustion outlets, and wherein the heat conduction tube is operable to use gravity to facilitate the circulation of air heated by the subunit when external electrical power is unavailable.

10. The system of claim 9, wherein the gravity-style furnace subunit further includes:

a combustion inducer coupled to a combustion outlet connected to the heat conduction tube; and an air blower located below the gravity-style heat conduction tube and configured to blow air across an outer surface of the heat conduction tube, wherein the combustion inducer, the combustion outlet and the air blower are separate from the gas-induced draft furnace.

11. The system of claim 10, where one or both of the combustion inducer and the air blower are powered by the thermopile module.

12. The system of claim 9, wherein the cabinet is located in a lowest level of a building that the gravity-style furnace subunit and the gas-induced draft furnace are configured to heat.

13. A gravity-style furnace subunit, comprising:

a heat conduction tube configured to be located inside of a gas-induced draft furnace cabinet, the heat conduction tube being separated from:

a row of draft-induced heat conduction tubes coupled to a first burner assembly, an electrically-powered air blower located adjacent to the row of draft-induced heat conduction tubes, and an electrically-powered draft inducer coupled to the row of draft-induced heat conduction tubes, wherein the row of draft-induced heat conduction tubes and the electrically powered air blower are located inside the cabinet; wherein the gravity-style furnace subunit further comprises:

a second different burner assembly having a burner tube located within the heat conduction tube through an inlet opening of the heat conduction tube, wherein the second burner assembly permits air flow through the inlet opening into the heat conduction tube;

a pilot assembly located within the heat conduction tube and adjacent to the burner tube; a thermopile module located adjacent to a flame outlet of the pilot assembly within the heat conduction tube; and a gas valve configured to control gas flow to the second burner assembly, wherein:

the pilot assembly is configured to be automatically activated by a control module of the subunit, the control module is configured to activate the pilot assembly to produce a pilot flame when, due to power-grid failure, the electrically-powered air blower is off for a predefined period, and the gas valve is electrically coupled to the thermopile module and is configured to allow gas flow therethrough when the thermopile module, upon exposure to the pilot flame, generates a predefined voltage difference that causes the gas valve to actuate to an open position;

wherein the gravity-style subunit and the draft-induced heat conduction tubes comprise separate air inlets and separate combustion outlets, and wherein the heat conduction tube is operable to use gravity to facilitate the circulation of air heated by the subunit when external electrical power is unavailable.

14. The subunit of claim 13, wherein the heat conduction tube is a clam-shell shaped tube.

15. The subunit of claim 13, wherein the gravity-style furnace subunit further includes a first air blower located adjacent to, and configured to blow return air over, an outer surface of the gravity-style heat conduction tube.

16. The subunit of claim 15, wherein the first air blower is configured to blow air across opposing outer clam-shell shaped surfaces of the heat conduction tube.

17. The subunit of claim 16, wherein the first air blower is electrically powered by a non-grid-tied electrical power source of a building heated by the gas-induced draft furnace.

18. The subunit of claim 13, wherein the control module is configured to deactivate the pilot assembly to turn off the pilot flame, whereby the predefined voltage difference is no longer generated and the gas valve actuates to a closed position, when electrical power from the power grid to the electrically-powered air blower is resumed for a predefined period.

19. The system of claim 18, wherein the control module is configured to deactivate the pilot assembly to turn off the pilot flame, whereby the predefined voltage difference is no longer generated and the gas valve actuates to a closed position, when electrical power from the power grid to the electrically-powered air blower is resumed for a predefined period.

* * * * *